US007128315B2

(12) United States Patent
Tsunematsu

(10) Patent No.: US 7,128,315 B2
(45) Date of Patent: Oct. 31, 2006

(54) DISCRETE PAPER FEEDER

(75) Inventor: Shinichiro Tsunematsu, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 511 days.

(21) Appl. No.: 10/669,744

(22) Filed: Sep. 25, 2003

(65) Prior Publication Data

US 2004/0061274 A1 Apr. 1, 2004

(30) Foreign Application Priority Data

Sep. 27, 2002 (JP) ..... 2002-283159

(51) Int. Cl.
*B65H 3/06* (2006.01)

(52) U.S. Cl. ..... 271/114; 475/331

(58) Field of Classification Search ..... 271/109, 271/116, 114, 10.11, 10.13; 475/11, 331; 74/55, 567

See application file for complete search history.

(56) References Cited

U.S. PATENT DOCUMENTS

| | | | | |
|---|---|---|---|---|
| 4,667,244 A | | 5/1987 | Ishikawa | |
| 5,116,038 A | | 5/1992 | Kim | |
| 5,155,603 A | * | 10/1992 | Seok-Jae | 358/498 |
| 5,240,239 A | | 8/1993 | Kim | |
| 5,624,109 A | | 4/1997 | Tanaka | |
| 5,678,817 A | * | 10/1997 | Saito et al. | 271/122 |
| 5,793,399 A | * | 8/1998 | Kawakami et al. | 347/104 |
| 6,025,936 A | * | 2/2000 | Ishida | 358/498 |
| 6,581,924 B1 | * | 6/2003 | Gaarder et al. | 271/114 |

FOREIGN PATENT DOCUMENTS

| | | |
|---|---|---|
| EP | 1 188 698 | 3/2002 |
| JP | 6-263273 | 9/1994 |

* cited by examiner

*Primary Examiner*—Patrick Mackey
*Assistant Examiner*—Thomas Morrison
(74) *Attorney, Agent, or Firm*—Wenderoth, Lind, Ponack, L.L.P.

(57) ABSTRACT

A discrete paper feeder includes a speed reduction mechanism for transmitting rotation of a driving motor to a separation roller, a disc member having grooves, a lever member on a grooved side of the disc member, and a slide pin projected from the lever member and slidable along the grooves upon disc member rotation. The speed reduction mechanism includes a sun gear, an internally-toothed gear, and planetary gears. The disc member is disposed on one end of the separation roller rotation shaft and secured to a geared section having the internally-toothed gear. The lever member is radially slideable relative to the disc member. A rotation stopping member regulates rotation of the lever member. This structure minimizes peripheral speed differences to prevent image distortion and elongation. Even when peripheral speed difference is minimized, a predetermined interval is provided between sequentially transferred manuscript sheets.

16 Claims, 11 Drawing Sheets

DISCRETE PAPER FEEDER

TECHNICAL FIELD

The present invention relates to a discrete paper feeder for use in facsimiles, printers, copying machines, etc., in which two or more sheets of manuscript or copying paper can be discretely transferred one by one.

BACKGROUND ART

In recent years, discrete paper feeders are used in facsimiles, printers, copying machines, etc., for discretely transferring two or more sheets of manuscript or copying paper one by one. In such a discrete paper feeder, it is necessary to detect the rear end of a manuscript with a sensor or the like disposed in the device in order to detect the completion of transfer of a sheet of the manuscript. For this purpose, it is necessary that the device be able to perceive that reading of a sheet of the manuscript has been completed. It is thus necessary to put intervals between successive sheets of a manuscript that are fed in sequence. In order to put intervals between successive sheets, various configurations can be employed such as to forcibly create feeding intervals by using a reverse roller, an electromagnetic clutch or a solenoid. Especially in the type of discrete paper feeders that have been developed in a large number, manuscript intervals are produced by creating a difference between the peripheral speeds of the rotation of a transfer roller and a separation roller and rotating the transfer roller at a speed 10% to 30% higher than that of the separation roller.

FIG. 14 is a perspective view of an essential part of an example of a conventional discrete paper feeder. Conventional discrete paper feeder 61 includes separation roller 62, transfer roller 63, separation plate 64, separation roller gear 65, delay member 66, one-way clutch spring 67, transfer roller gear 68, reader 69, and butting member 69A.

A description of the action of conventional discrete paper feeder 61 as configured above will be given with reference to the illustration.

Separation roller gear 65 and rotation shaft 62A transmit the power of a drive motor (not shown) to separation roller 62. Separation roller 62 is rotated by this power and transfers manuscript 80 toward reader 69 and transfer roller 63. During this process, manuscript 80 is discretely fed page by page by separation plate 64 that is disposed in a manner pressed to separation roller 62.

Transfer roller gear 68 and rotation shaft 63B transmit the power of a drive motor (not shown) to transfer roller 63. Transfer roller 63 is rotated by this power. Here, the device is so structured that transfer roller 63 is rotated at a peripheral speed that is 10% to 30% higher than that of separation roller 62. Such a structure is realized by selecting gear ratios of two or more transmission gears (not shown) that transmit the power of the drive motor. This difference in the peripheral speeds generates a time difference between the time when manuscript 80 is bitten and transferred by transfer roller 63 and the time when the next sheet of manuscript is bitten by separation roller 62 and transferred to and bitten by transfer roller 63. This time difference creates an interval between two consecutively transferred manuscript sheets.

One-way clutch spring 67 is provided in the part where rotation shaft 62A of separation roller 62 and separation roller gear 65 are coupled for absorbing the peripheral speed difference between separation roller 62 and transfer roller 63. Furthermore, delay member 66 is provided in the part where rotation shaft 62A of separation roller 62 and separation roller gear 65 are coupled. That is, rotation shaft 62A and separation roller gear 65 are coupled with play. Because of this structure, the timing of biting a manuscript by separation roller 63 is delayed thus causing a further increase in the interval of manuscript sheets.

In such discrete paper feeder 61, a single transfer roller 63 is disposed, and reader 69 is disposed between separation roller 62 and transfer roller 63. This is for the sake of reduction in size and manufacturing cost. With this structure, before manuscript 80 that is bitten by separation roller 62 and transferred is bitten by transfer roller 63, reading of manuscript 80 by reader 69 is started. When manuscript 80 is bitten by transfer roller 63, manuscript 80 is transferred from that position at the peripheral speed of transfer roller 63. Consequently, the transfer speed of manuscript 80 changes due to a difference between the peripheral speeds of separation roller 62 and transfer roller 63. Accordingly, distortion and elongation of the image read from manuscript 80 by reader 69 is caused at the position where the transfer speed changes. In order to cope with this situation, in discrete paper feeder 61, the peripheral speed difference between separation roller 62 and transfer roller 63 is made to be as small as possible to minimize the distortion and elongation of read images so that the distortion will not be prominent. Furthermore, with a view to minimizing the distortion and elongation of the read images due to peripheral speed difference between separation roller 62 and transfer roller 63, transfer roller 63 is disposed as close to reader 69 as possible in a manner pressed against butting member 69A.

Also, another example of a conventional discrete paper feeder as disclosed in Japanese Patent Laid-Open Application No. H6-263273 includes a sun gear, a planetary arm and a planetary gear, a planetary gear shaft, and a pressing spring. The device also includes a fixed-disc cam mechanism for absorbing pressing force of the pressing spring via the planetary gear and at the same time allowing rotation and revolution of the planetary gear.

However, the conventional discrete paper feeders as described above suffer from the following problems.

(1) Even when transfer roller 63 is disposed close to reader 69 as described above, distortion and elongation of read images occur at the front end of manuscript 80, making the transmitted manuscript hard to read or spoiling the appearance.

(2) There is a limit in setting the peripheral speed difference as a sufficient interval between manuscript sheets cannot be obtained when the peripheral speed difference is made too small. If a sufficient manuscript interval is to be obtained, occurrence of distortion and elongation of the read image of a manuscript is unavoidable.

(3) If the reader is of high performance, it is possible to read a manuscript at a high speed by increasing the speed of transfer. Here, the peripheral speed difference has to be small as entry of a manuscript under transfer roller 63 cannot be smoothly performed. However, when the peripheral speed difference is made too small, a predetermined manuscript interval cannot be obtained.

DISCLOSURE OF THE INVENTION

The discrete paper feeder in accordance with the present invention includes a separation roller for separating a sheet of paper from two or more sheets to be loaded and a transfer roller provided downstream of the separation roller in a direction of transfer of the sheet and driven to rotate with a predetermined peripheral speed difference relative to the separation roller. It also includes a sun gear, a ring-shaped geared section disposed coaxially with the sun gear and having an internally-toothed gear provided on the inner periphery, and a planetary gear engaging the sun gear and the internally-toothed gear supported on a planetary gear support section provided on an end portion of the rotation shaft of the separation roller. It further includes a disc member having a first side secured to the ring-shaped geared section and a second side having grooves formed therein, and a lever member provided on the second side of the disc member in a manner slidable in the radial direction of the disc member. It still further includes a rotation stopping section for regulating rotation of the lever member in a predetermined direction and a slide pin projecting from the lever member and slidable along the grooves provided on the disc member upon rotation of the disc member.

BRIEF DESCRIPTION OF THE DRAWINGS

FIG. 5A is an illustration of the action of the disc member and a lever member of the discrete paper feeder of FIG. 1 while standing by.

FIG. 5B is an illustration of the action of a separation roller and a transfer roller of the discrete paper feeder of FIG. 1 while standing by.

FIG. 5C is an illustration of the action of the sun gear and the planetary gears of the discrete paper feeder of FIG. 1 while standing by.

DETAILED DESCRIPTION OF PREFERRED EMBODIMENTS

Figure 1:
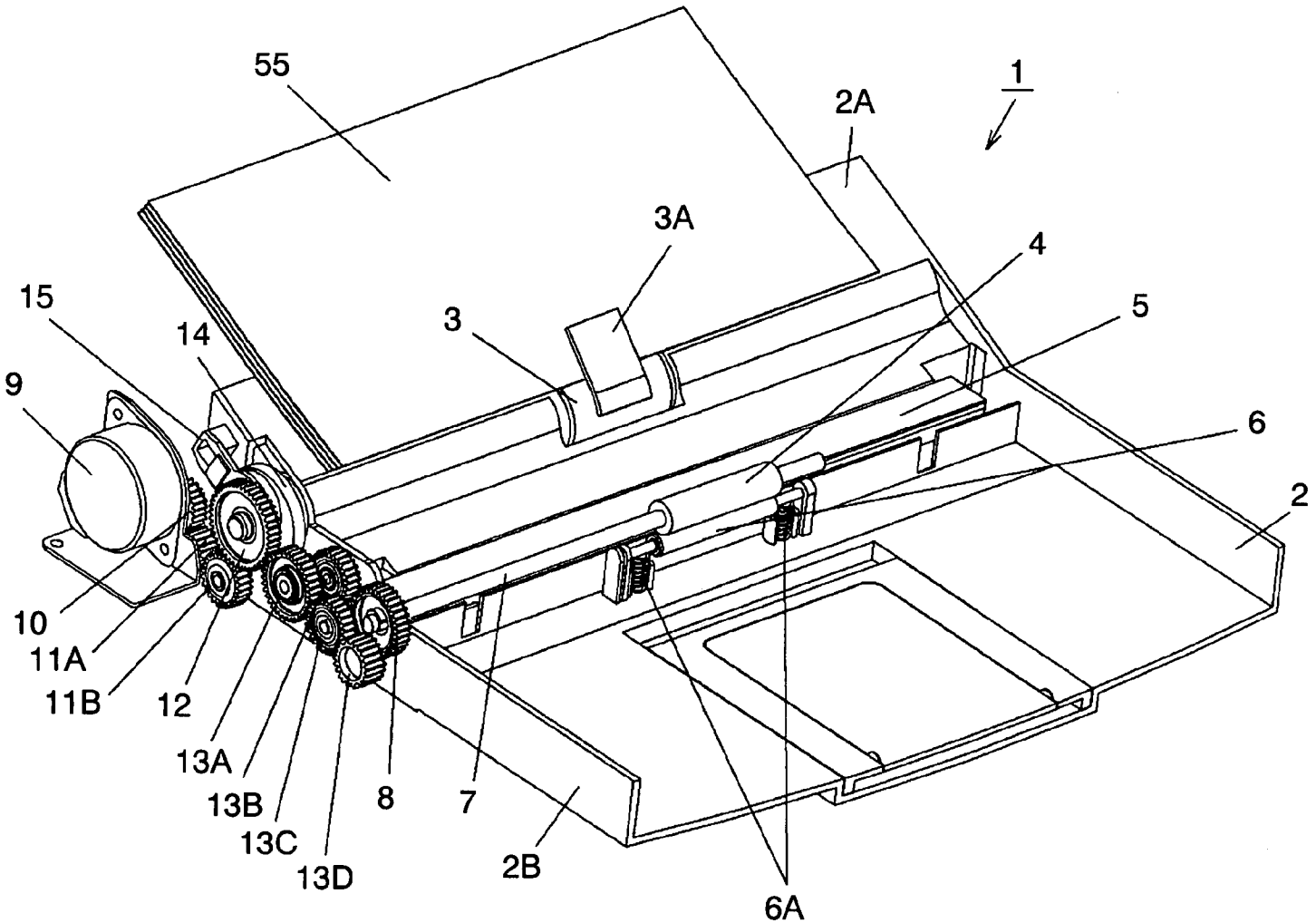
FIG. 1 is a perspective view of a discrete paper feeder in an exemplary embodiment of the present invention.
Figure 2A:
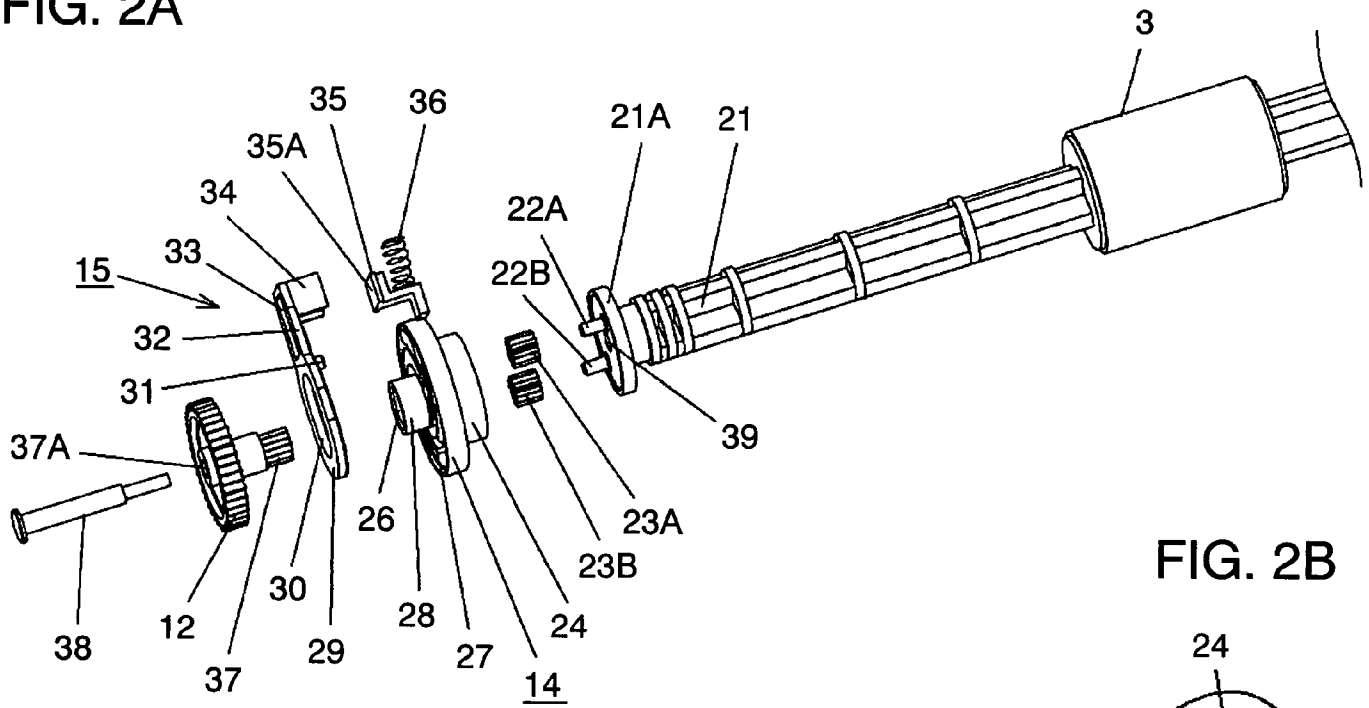
FIG. 2A is an exploded perspective view of an essential part of the discrete paper feeder of FIG. 1.
Figure 2B:
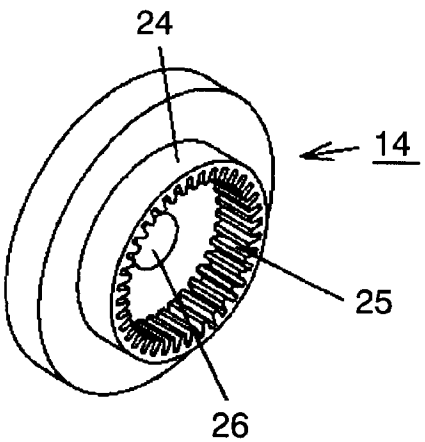
FIG. 2B is a perspective view of a disc member of FIG. 2A.
Figure 3:
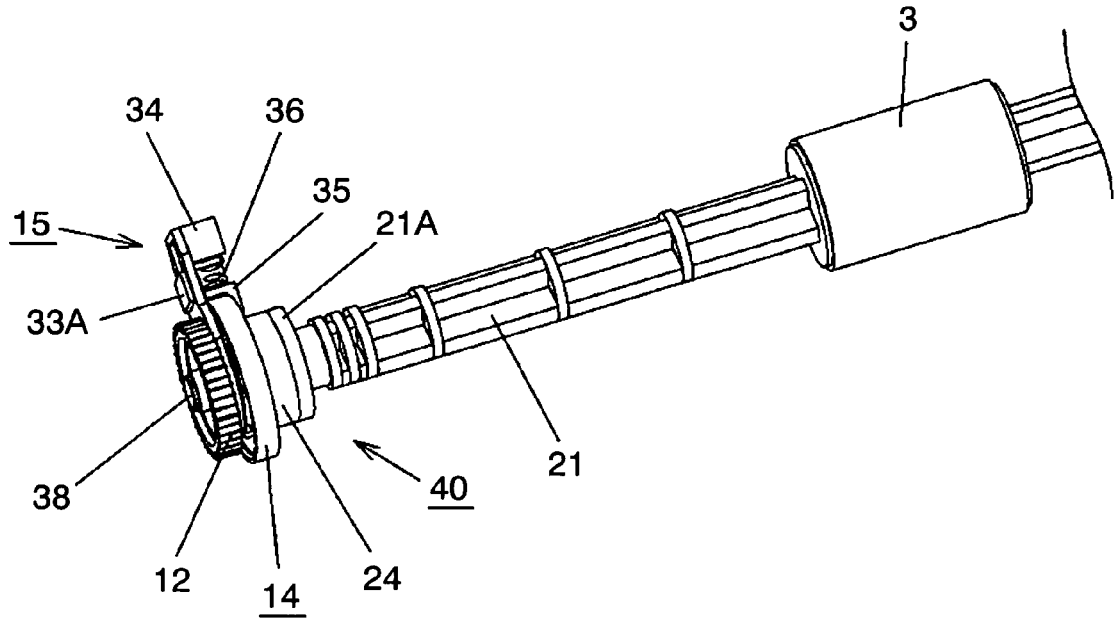
FIG. 3 is an assembled perspective view of an essential part of the discrete paper feeder of FIG. 1.
Figure 4:
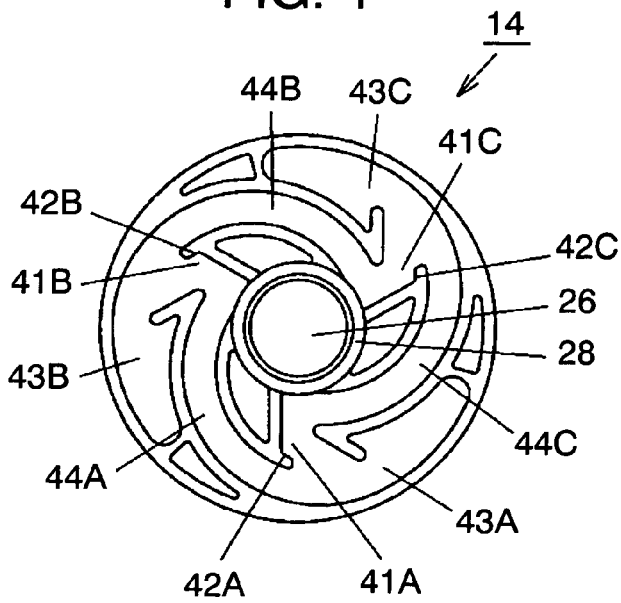
FIG. 4 is a front view of a grooved section formed on a disc member of the discrete paper feeder of FIG. 1.

FIG. 1 is a perspective view of a discrete paper feeder in an exemplary embodiment. FIG. 2A is an exploded perspective view of an essential part of the discrete paper feeder. FIG. 2B is a perspective view of a disc member of the discrete paper feeder. FIG. 3 is a perspective view of an essential part of the discrete paper feeder as assembled. FIG. 4 is a front view of a grooved section formed on a disc member of the discrete paper feeder.

In FIG. 1, discrete paper feeder 1 includes paper loading section 2A (hereinafter loading section) disposed on the rear upper surface of casing 2 having side plate 2B. Separation roller 3 is disposed at loading section 2A on the side of direction of transfer of a manuscript. Separation plate 3A is disposed on top of separation roller 3 so as to touch separation roller 3 and separates a single page from two or more pages of a manuscript. Transfer roller 4 is spaced a predetermined distance downstream (in the direction of transfer of a manuscript) from separation roller 3. Reader 5 is disposed between separation roller 3 and transfer roller 4. Reader 5 comprises a CIS (contact image sensor) etc.

Auxiliary roller 6 is disposed under and in contact with transfer roller 4. Pressing springs 6A press auxiliary roller 6 toward transfer roller 4. Transfer roller gear 8 is disposed on one end of rotation shaft 7 of transfer roller 4. Drive motor 9 rotates separation roller 3 and transfer roller 4 via transmission gears 11A, 11B, 13A, 13B, 13C, 13D, separation roller gear 12, and transfer roller gear 8 with a predetermined peripheral speed difference. Drive motor gear 10 is disposed on the motor shaft of drive motor 9.

Transmission gears 11A, 11B transmit rotation of drive motor gear 10 to separation roller gear 12. Separation roller gear 12 engages transmission gear 11B. Transmission gears 13A, 13B, 13C, 13D are disposed on side plate 2B in a manner engaging with each other and transmit rotation of separation roller gear 12 to transfer roller gear 8. Disc member 14 is disposed on one end of the rotation shaft of separation roller 3 together with separation roller gear 12. Lever member 15 is provided so as to be accompanied with disc section 14.

In FIG. 2A, FIG. 2B and FIG. 3, disc section 21A is secured to one end of rotation shaft 21 of separation roller 3. Planetary gear support sections 22A, 22B are disposed in a manner vertically symmetrical relative to the center of disc section 21A, that is, the axis of the rotation shaft of separation roller 3. Planetary gears 23A, 23B are supported by planetary gear support sections 22A, 22B, respectively. Geared section 24 is secured to the side of disc member 14 that faces separation roller 3. Internally-toothed gear 25 is formed on the inner periphery of geared section 24. Insertion hole 26 is bored in the center of disc member 14. Grooved section 27 is formed on the side of disc member 14 opposite geared section 24. Cylindrical shaft section 28 having insertion hole 26 in it is disposed in a manner projecting from the side of grooved section 27 of disc member 14.

Annular section 29 of lever member 15 is fit to shaft section 28. Insertion hole 30 of annular section 29 has play in a predetermined direction and is formed in a roughly elliptical shape. Slide pin 31 is provided on annular section 29 of lever member 15 in a projecting manner and is slidably disposed in grooved section 27. Rotation stopping section 32 is secured to the periphery of annular section 29 and engages engagement member 51 illustrated in later-described FIG. 5A. Slide groove 33 is formed on rotation stopping section 32. Pressing member 35 is pressed to the periphery of disc member 14. Slide member 35A is an integral part of pressing member 35 and is slidably fit in groove 33.

Resilient member support section 34 is disposed on the tip of rotation stopping section 32. One end of resilient member 36 is secured to pressing member 35 and the other end is supported by resilient member support section 34. Resilient member 36 presses pressing member 35 to the periphery of disc member 14. Resilient member 36 is a coil spring, for example. Sun gear 37 integrally formed with separation roller gear 12 is inserted via insertion hole 26 and disposed inside internally-toothed gear 25 while engaging planetary gears 23A, 23B.

Insertion hole 37A is formed in the centers of separation roller gear 12 and sun gear 37. Speed reduction mechanism 40 consists of sun gear 37, planetary gears 23A, 23B and internally-toothed gear 25. Shaft 38 is inserted into insertion hole 37A and insertion hole 26, and rotatably supports separation roller gear 12, sun gear 37 and disc member 14. Shaft securing hole 39 is formed in rotation shaft 21, and one end of shaft 38 is inserted and secured thereinto.

In FIG. 4, engagement grooves (hereinafter grooves) 41A, 41B, 41C are provided in a manner symmetrical with respect to the center of disc member 14. Engagement sections 42A, 42B, 42C are disposed in respective engagement grooves 41A, 41B, 41C. Sliding grooves for peripheral speed difference (hereinafter grooves) 43A, 43B, 43C are provided in series with grooves 41A, 41B, 41C respectively at the side of the periphery of disc member 14 and along the periphery of disc member 14. Sliding grooves for manuscript interval (hereinafter grooves) 44A, 44B, 44C are provided in a manner extending from respective grooves 43A, 43B, 43C on disc member 14 in the clockwise direction. Here, grooves 41A, 41B, 41C, grooves 43A, 43B, 43C, and grooves 44A, 44B, 44C are provided on disc member 14 at even intervals in a manner symmetrical with respect to the center of disc member 14. Grooves 41A, 41B, 41C and engagement sections 42A, 42B, 43C are respectively provided at an interval angle of 120 degrees with respect to each other. Also, grooves 44A, 44B, 44C extend in the clockwise direction on disc member 14 and are respectively connected to grooves 41B, 41C, 41A. A drive power control section comprises speed reduction mechanism 40, disc member 14, lever member 15 that includes rotation stopping section 32, and slide pin 31.

Referring to the drawings, a description will now be given of the action of the discrete paper feeder in this exemplary embodiment as configured above. The description will be given on the action of discrete paper feeder 1 for each of the following states:

(1) Standing by: the state before feeding a manuscript in which the drive motor is stopped.

(2) Pre-feeding and feeding a manuscript: the state in which the drive motor is driven, a manuscript page is bitten by the separation roller until it is bitten by the transfer roller.

(3) Reading a manuscript: the state in which a manuscript page is being bitten by both the separation roller and the transfer roller.

(4) Reading a manuscript (after leaving the separation roller):

the state in which a manuscript page leaves the separation roller and is bitten by the transfer roller.

(5) Restarting paper-feeding: the state in which a manuscript page is transferred and leaves the transfer roller.

Figure 5A:
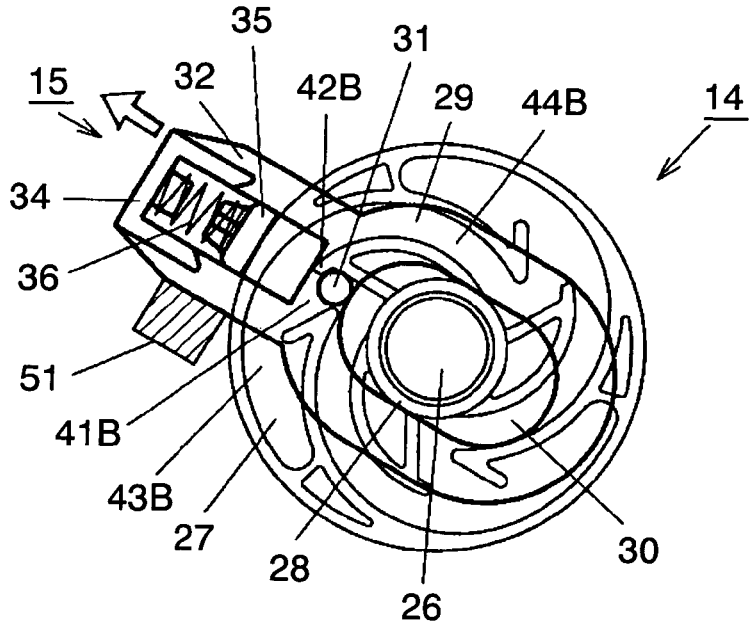
Figure 5B:
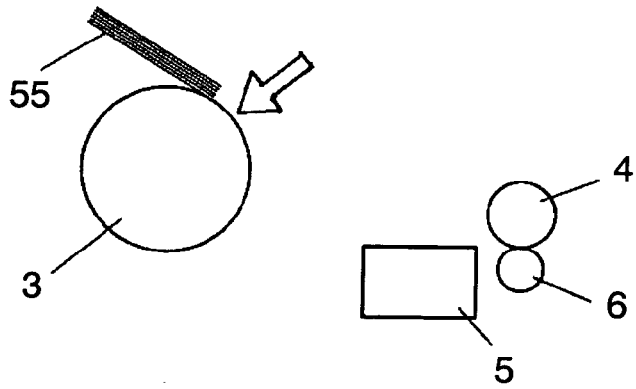
Figure 5C:
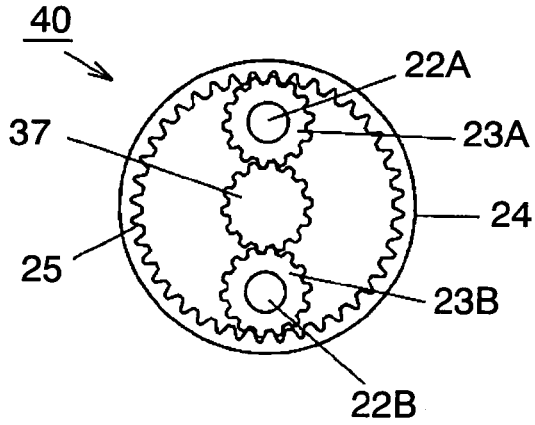

(1) Standing by:

FIG. 5A illustrates the action of disc member 14 and lever member 15. FIG. 5B illustrates the action of separation roller 3 and transfer roller 4. FIG. 5C illustrates the action of sun gear 37, internally-toothed gear 25, and planetary gears 23A, 23B in speed reduction mechanism 40. Here, FIG. 5A to FIG. 5C are schematic side, views of the discrete paper feeder as viewed from the left side of the device.

Engagement member 51 located on side plate 2B of casing 2 is secured at a position so that rotation stopping section 32 of lever member 15 can come into contact with engagement member 51. Rotation of lever member 15 in a predetermined direction (counterclockwise rotation) is regulated by striking of rotation stopping section 32 against engagement member 51.

As shown in FIG. 5A, lever member 15 consists of annular section 29 and rotation stopping section 32. Annular section 29 is formed into a roughly elliptical shape. Insertion hole 30 inside annular section 29 has play on the side of rotation stopping section 32 and on the opposite side. Annular section 29 is fit to shaft 28 of disc member 14. Also, rotation stopping section 32 touches and engages engagement member 51 provided in the counterclockwise direction. This allows lever member 15 to be slidable along the radial direction of disc member 14. Also, slide member 35A of pressing member 35 is fit in a manner slidable in the slide groove of rotation stopping section 32, and pressing member 35 is slidably disposed on the side of disc member 14. Furthermore, resilient member 36 is disposed in resilient member support section 34 of rotation stopping section 32 and resilient member 36 presses pressing member 35 to the periphery of disc member 14. With this arrangement, lever member 15 is constantly urged in the radially outward direction of disc member 14 as shown by the arrow.

While standing by, slide pin 31 of rotation stopping section 32 is disposed in groove 41B of disc member 14. Also, slide pin 31 is urged outwardly of disc member 14 together with lever member 15 and engages engagement section 42B. Furthermore, rotation stopping section 32 engages engagement member 51. With this arrangement, even when a counterclockwise rotational force is applied to disc member 14, disc member 14 will not rotate.

Also, while standing by, drive motor 9 is not in motion and separation roller 3, transfer roller 4, and speed reduction mechanism 40 are at a standstill as illustrated in FIG. 5B and FIG. 5C.

Figure 6A:
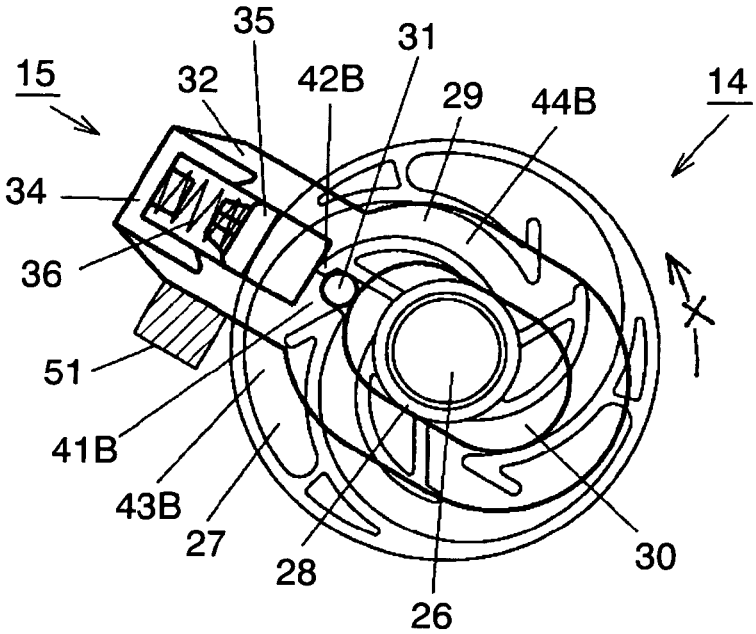
FIG. 6A is an illustration of the action of the disc member and the lever member of the discrete paper feeder of FIG. 1 while pre-feeding and feeding a manuscript.
Figure 6B:
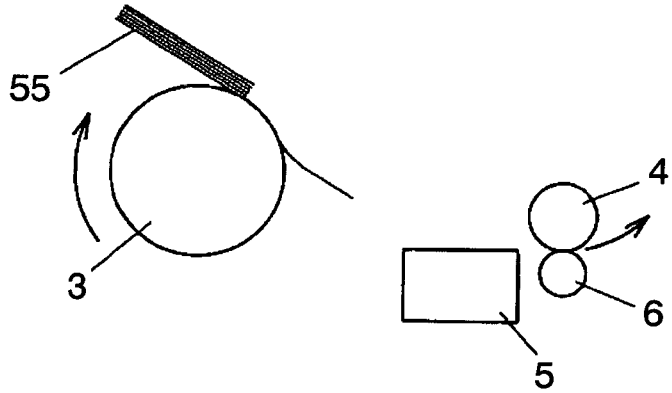
FIG. 6B is an illustration of the action of the separation roller and the transport roller of the discrete paper feeder of FIG. 1 while pre-feeding and feeding a manuscript.
Figure 6C:
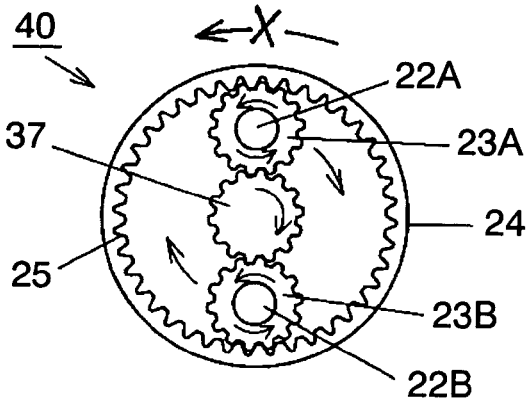
FIG. 6C is an illustration of the action of the sun gear and the planetary gears of the discrete paper feeder of FIG. 1 while pre-feeding and feeding a manuscript.

(2) Pre-feeding and Feeding a Manuscript:

FIG. 6A is an illustration of the action of disc member 14 and lever member 15. FIG. 6B is an illustration of the action of separation roller 3 and transfer roller 4. FIG. 6C is an illustration of the action of sun gear 37, internally-toothed gear 25, and planetary gears 23A, 23B in speed reduction mechanism 40.

As shown in FIG. 6A, slide pin 31 provided on lever member 15 is in groove 41B of disc member 14 and is in contact with engagement section 42B. Also, as rotation stopping section 32 of lever member 15 is engaged with engagement member 51, disc member 14 will not rotate even when a counterclockwise rotational force is applied to disc member 14 as shown by the arrow.

When drive motor 9 is driven at a standby state illustrated in FIG. 5A to FIG. 5C, separation roller gear 12 is rotated via transmission gears 11A, 11B. When separation roller gear 12 is rotated, sun gear 37 secured to separation roller gear 12 is rotated, and each of planetary gears 23A, 23B that engage sun gear 37 from the top and bottom is rotated. And, as planetary gears 23A, 23B are in engagement with internally-toothed gear 25, a rotational force is applied to geared section 24 in the direction of the arrow. However, as counterclockwise rotation of disc member 14 that is integral with geared section 24 is braked by slide pin 31, each of planetary gears 23A, 23B moves around sun gear 37 while it rotates on its own axis. With this, rotation shaft 21 of separation roller 3 is rotated via planetary gear support sections 22A, 22B thus rotating separation roller 3.

Initially, as separation plate 3A is in direct contact with separation roller 3, the anti-rotation resistance of separation roller 3 is large. However, when manuscript 55 comes between them, the anti-rotation resistance of separation roller 3 is reduced to some extent. By the rotation of separation roller 3, manuscript 55 is transferred toward reader 5 and transfer roller 4 as illustrated in FIG. 6B.

In the meantime, speed reduction mechanism 40 is set up in a manner that, for each turn of separation roller gear 12 secured to sun gear 37, separation roller 3 rotates by about ¼ turn. To be more specific, the diameter and number of teeth of sun gear 37, planetary gears 23A, 23B, and internally-toothed gear 25 are chosen to provide the above reduction ratio.

Also, by the rotation of separation roller gear 12, transfer roller gear 8 is rotated via transmission gears 13A to 13D, and transfer roller 4 and auxiliary roller 6 which is in contact with transfer roller 4 are rotated via rotation shaft 7.

Figure 7A:
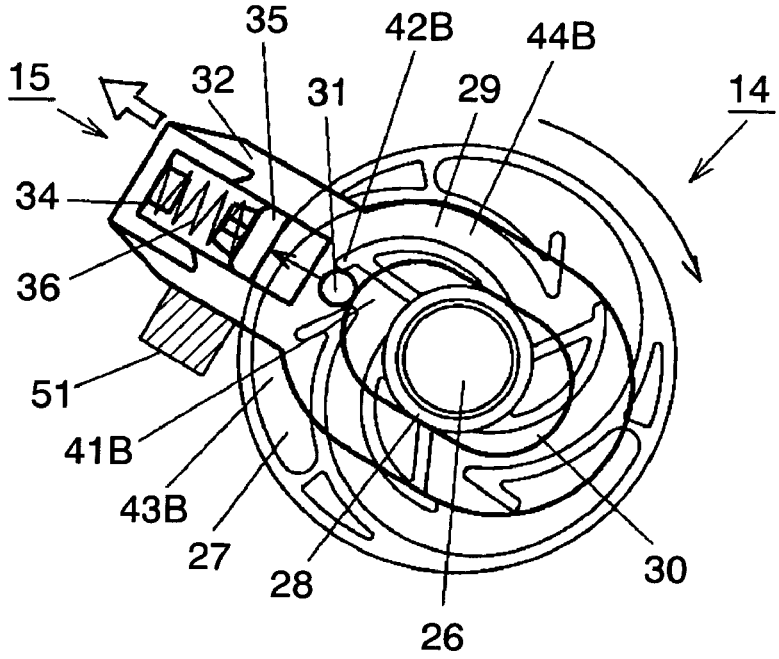
FIG. 7A is an illustration of the action of the disc member and the lever member of the discrete paper feeder of FIG. 1 while reading a manuscript.
Figure 7B:
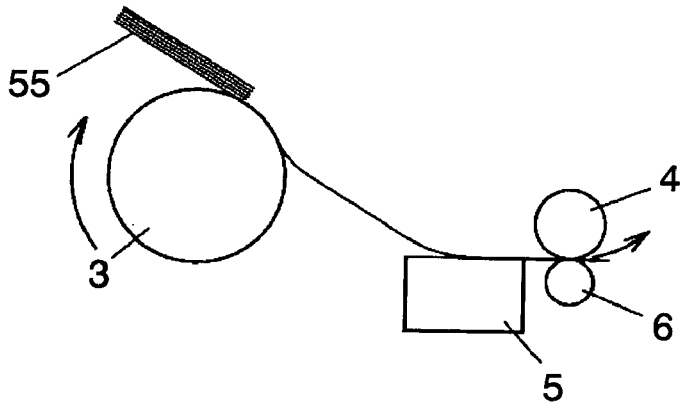
FIG. 7B is an illustration of the action of the separation roller and the transfer roller of the discrete paper feeder of FIG. 1 while reading a manuscript.
Figure 7C:
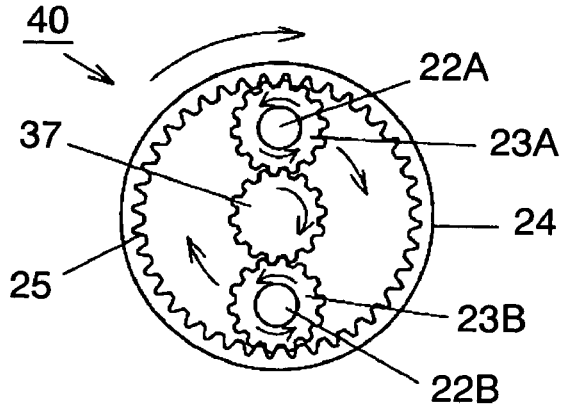
FIG. 7C is an illustration of the action of the sun gear and the planetary gears of the discrete paper feeder of FIG. 1 while reading a manuscript.
Figure 8:
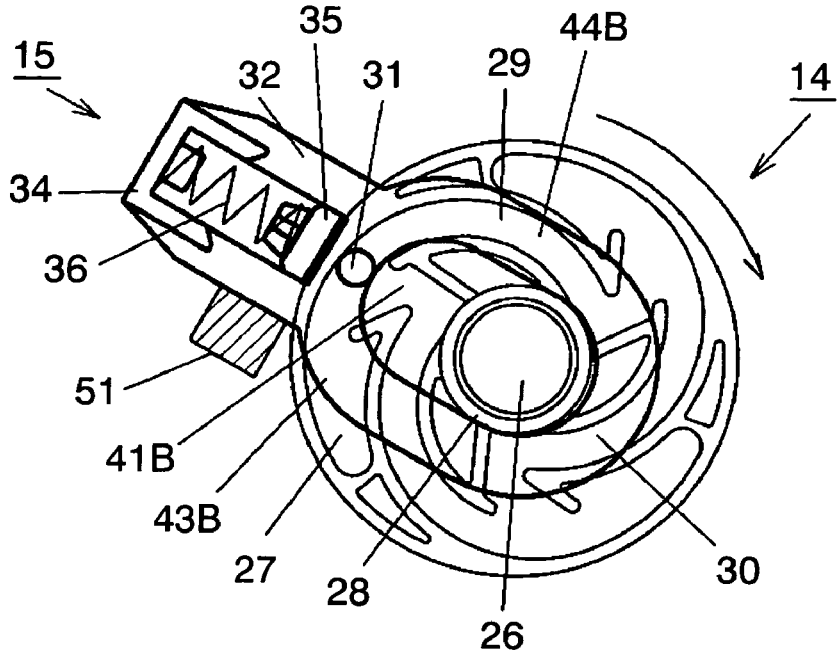
FIG. 8 and FIG. 9 are illustrations of the action of the disc member and the lever member of the discrete paper feeder of FIG. 1 while reading a manuscript.
Figure 9:
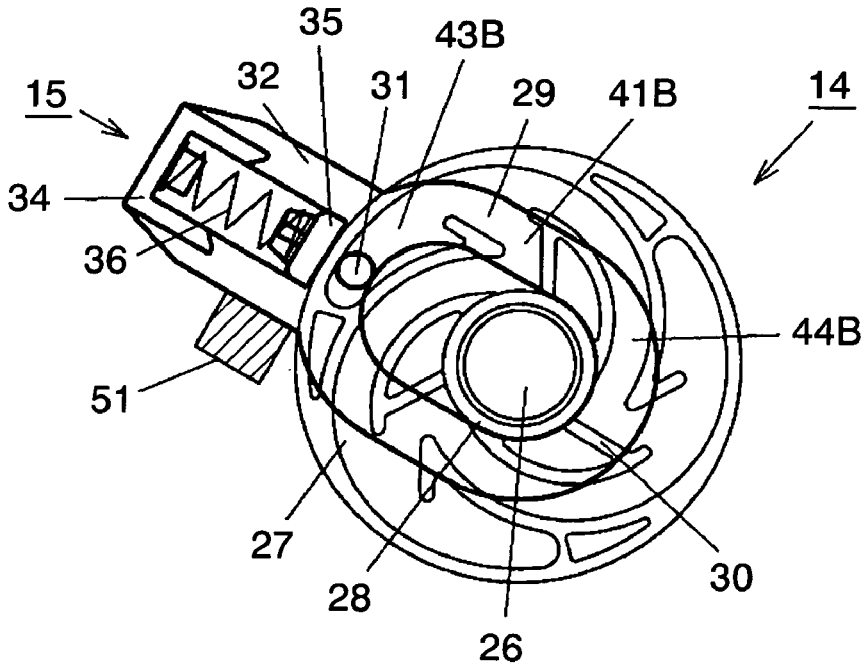

(3) Reading a Manuscript:

FIG. 7A, FIG. 8 and FIG. 9 illustrate the action of disc member 14 and lever member 15. FIG. 7B illustrates the action of separation roller 3 and transfer roller 4. FIG. 7C illustrates the action of sun gear 37, internally-toothed gear 25 and planetary gears 23A, 23B in speed reduction mechanism 40.

From the state of pre-feeding and feeding a manuscript as shown in FIG. 6A to FIG. 6C, manuscript 55 is further transferred toward reader 5 by separation roller 3. Then, as shown in FIG. 7B, reading of manuscript 55 is started by reader 5 and manuscript 55 is further transferred to transfer roller 4 and is bitten by transfer roller 4. Here, for separation roller 3 and transfer roller 4, a predetermined peripheral speed difference is set. As the peripheral speed of transfer roller 4 is higher than that of separation roller 3, manuscript 55 bitten by separation roller 3 is pulled to transfer roller 4 little by little. By being pulled by manuscript 55, the rotational speed of separation roller 3 becomes faster by the amount of the peripheral speed difference. As a result, the amount of this extra rotation is transmitted from separation roller 3 via rotation shaft 21, planetary gear support sections 22A, 22B, planetary gears 23A, 23B, and internally-toothed gear 25 as a force to cause clockwise rotation. By this, geared section 24 makes clockwise rotation little by little as shown by the arrow in FIG. 7C. That is, the peripheral speed difference between separation roller 3 and transfer roller 4 is absorbed.

When geared section 24 rotates clockwise, disc member 14 secured to geared section 24 likewise rotates clockwise as shown in FIG. 7A. At that time, slide pin 31 is disengaged from engagement section 42B, lever member 15 moves away from disc member 14 by the force of resilient member 36, and slide pin 31 moves toward groove 43B.

When disc member 14 rotates clockwise, some force for clockwise rotation is exerted to lever member 15 due to a small friction between pressing member 35 and disc member 14. However, by the own weights of rotation stopping section 32 that is integral with lever member 15 and resilient member support section 34, lever member 15 will not rotate following disc member 14 and always remains in contact with engagement member 51. In the event of their own weight being insufficient, an appropriate weight may be disposed on lever member 15. By this, as only disc member 14 rotates clockwise, slide pin 31 of lever member 15 is disengaged from engagement section 42B.

When geared section 24 and disc member 14 rotate further clockwise, slide pin 31 moves from groove 41B of disc member 14 to groove 43B on the outer side as illustrated in FIG. 8. When disc member 14 rotates still further clockwise, slide pin 31 moves along groove 43B until it reaches the innermost part of groove 43B as illustrated in FIG. 9. Namely, slide pin 31 moves counterclockwise relative to disc member 14 along groove 43B. The length of groove 43B is set in a manner such that slide pin 31 can move to the innermost part as shown in FIG. 9, even when the length of manuscript 55 in the direction of transfer is 356 mm, i.e., legal size document length which is long among generally encountered manuscript sizes.

Figure 10A:
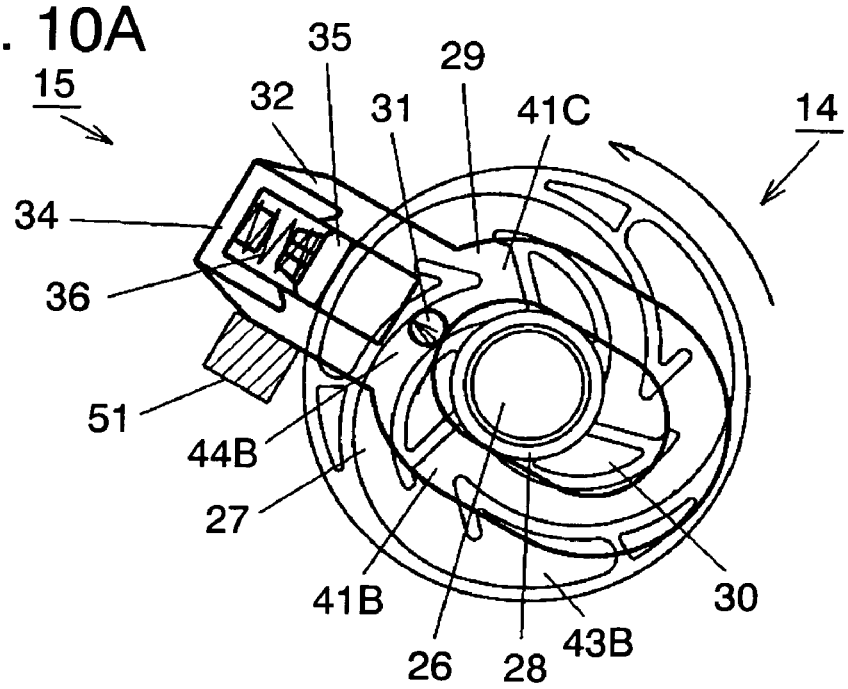
FIG. 10A is an illustration of the action of the disc member and the lever member of the discrete paper feeder of FIG. 1 while reading a manuscript.
Figure 10B:
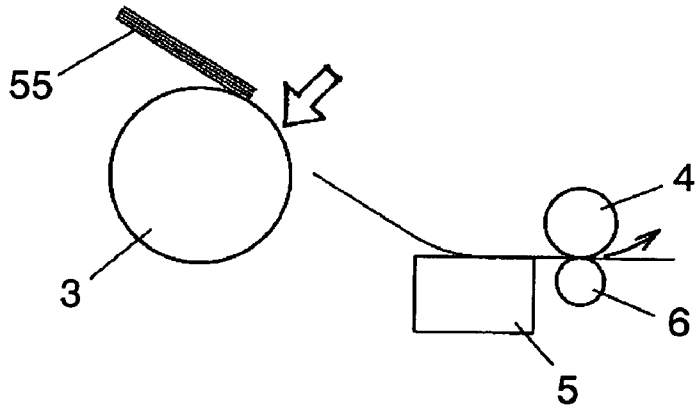
FIG. 10B is an illustration of the action of the separation roller and the transfer roller of the discrete paper feeder of FIG. 1 while reading a manuscript.
Figure 10C:
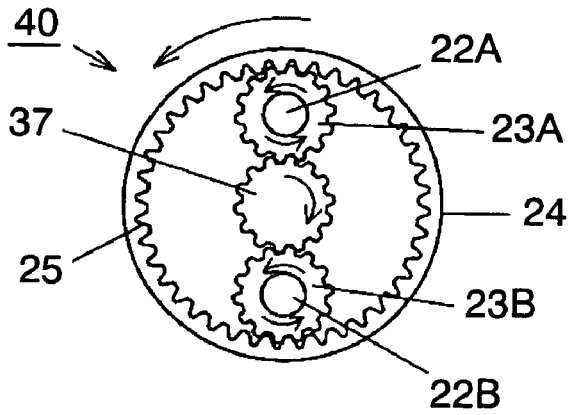
FIG. 10C is an illustration of the action of a sun gear and planetary gears of the discrete paper feeder of FIG. 1 while reading a manuscript.

(4) Reading a Manuscript (after Leaving the Separation Roller):

FIG. 10A illustrates the action of disc member 14 and lever member 15. FIG. 10B illustrates the action of separation roller 3 and transfer roller 4. FIG. 10C illustrates the action of sun gear 37, internally-toothed gear 25, and planetary gears 23A, 23B in speed reduction mechanism 40.

As shown in FIG. 9, slide pin 31 moves along groove 43B until it reaches the innermost part of groove 43B. After manuscript 55 leaves separation roller 3, manuscript 55 is bitten by transfer roller 4 only as shown in FIG. 10B and is further transferred by transfer roller 4 in the direction of transfer.

When manuscript 55 leaves separation roller 3, separation plate 3A comes into direct contact with separation roller 3 thus increasing resistance against rotation and stopping the rotation of separation roller 3. When the rotation of separation roller 3 stops, the rotation of planetary gear support sections 22A, 22B is stopped. Then, the rotation of sun gear 37 is strongly transmitted to internally-toothed gear 25 via planetary gears 23A, 23B as shown in FIG. 10C. With this, both geared section 24 and disc member 14 rotate in the counterclockwise direction.

When manuscript 55 leaves separation roller 3 and disc member 14 rotates counterclockwise, slide pin 31 moves from the innermost part shown in FIG. 9 along groove 43B.

It further moves along groove 44B as shown in FIG. 10A. During this period, the transmission of driving force to separation roller 3 is interrupted.

In this way, during the period when slide pin 31 is moving along groove 44B from the innermost part of groove 43B, separation roller 3 is at a standstill. Accordingly, the next page of manuscript is not fed. This creates predetermined intervals between sequentially fed pages of manuscript 55. The lengths of groove 43B and groove 44B determine the manuscript interval.

Figure 11A:
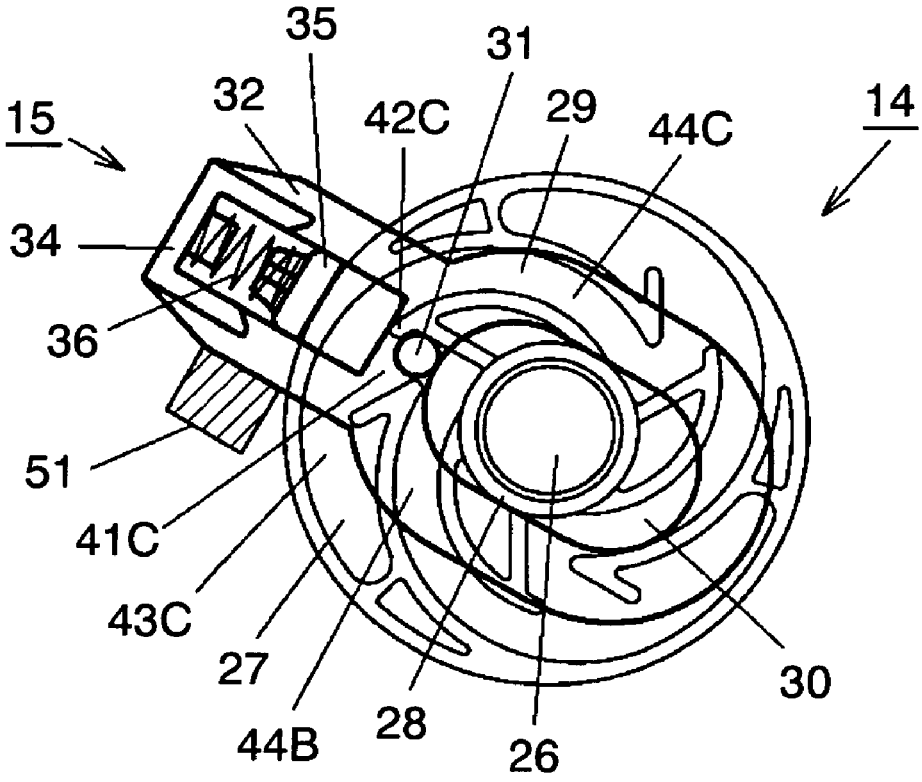
FIG. 11A is an illustration of the action of the disc member and the lever member of the discrete paper feeder of FIG. 1 while restarting paper-feeding.
Figure 11B:
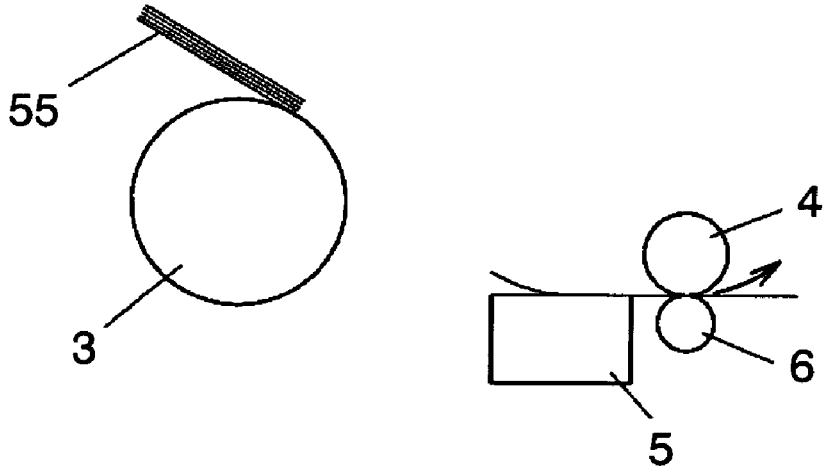
FIG. 11B is an illustration of the action of the separation roller and the transfer roller of the discrete paper feeder of FIG. 1 while restarting paper-feeding.

(5) Restarting Paper-Feeding:

FIG. 11A illustrates the action of disc member 14 and lever member 15. FIG. 11B illustrates the action of separation roller 3 and transfer roller 4.

As shown in FIG. 10A, slide pin 31 moves along groove 44B until it reaches the front end of groove 44B. Then slide pin 31 is moved by the urging force of resilient member 36 to groove 41C in the outward direction of disc member 14 and engages engagement section 42C as shown in FIG. 11A. Also, rotation stopping section 32 of lever member 15 engages engagement member 51. By this, counterclockwise rotation of disc member 14 is stopped.

Subsequently, feeding of the next page of manuscript 55 is performed in the same action as in "(2) Pre-feeding and feeding a manuscript." During the period drive motor 9 is in operation, the above-described cycle of "(2) Pre-feeding and feeding a manuscript", then "(3) Reading a manuscript", then "(4) Reading a manuscript (after leaving separation roller)", then "(5) Resuming paper feeding", then "(2) Pre-feeding and feeding a manuscript" is repeated. And paper feeding is performed with predetermined intervals between pages of manuscript 55 that are fed as shown in FIG. 11B. Such a repetitive action is enabled as grooved section 27 and engagement sections 42A, 42B, 42C are arranged in a manner symmetric with respect to a point.

In the event the length in the direction of transfer of manuscript 55 is longer than the general length of 356 mm, even when slide pin 30 moves to the innermost part shown in FIG. 9, manuscript 55 does not leave separation roller 3 and remains bitten by separation roller 3. A description of this case is given below.

Figure 12A:
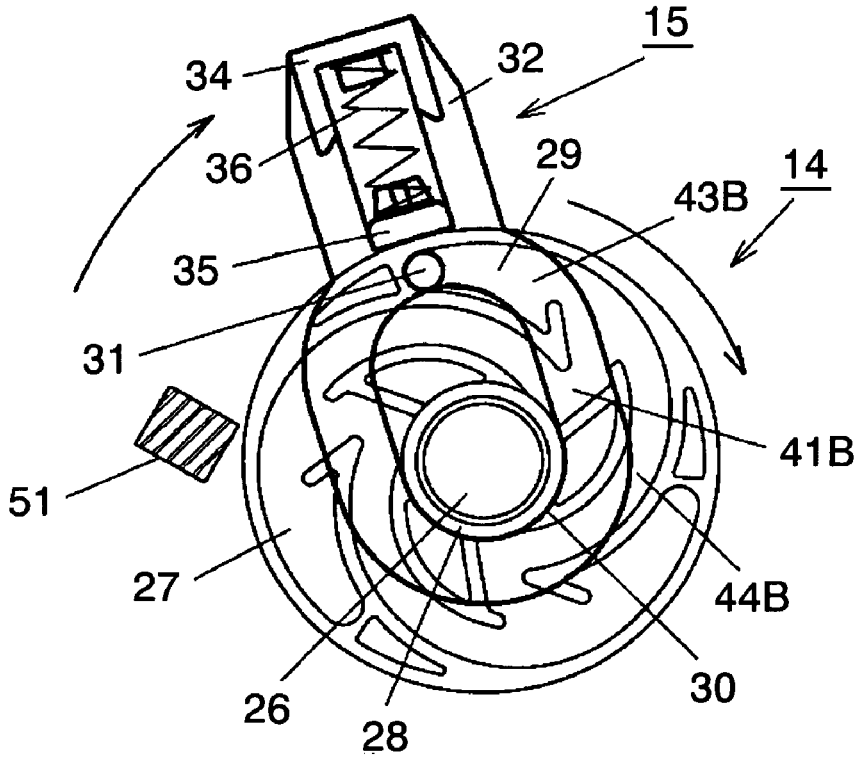
FIG. 12A is an illustration of the action of the disc member and the lever member of the discrete paper feeder of FIG. 1 while transferring a long manuscript.
Figure 12B:
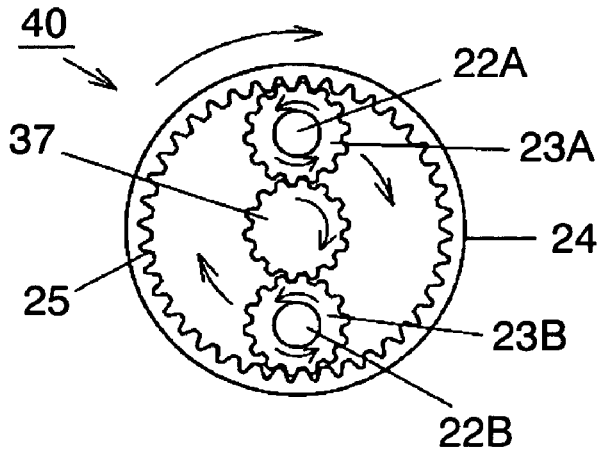
FIG. 12B is an illustration of the action of the sun gear and the planetary gears of the discrete paper feeder of FIG. 1 while transferring a long manuscript.

FIG. 12A illustrates the action of disc member 14 and lever member 15. FIG. 12B illustrates the action of sun gear 37, internally-toothed gear 25, and planetary gears 23A, 23B in speed reduction mechanism 40.

Manuscript 55 bitten by separation roller 3 is pulled little by little toward transfer roller 4 due to the peripheral speed difference between separation roller 3 and transfer roller 4, and separation roller 3 rotates extra by an amount corresponding to the peripheral speed difference. As shown in FIG. 12B, the amount of extra rotation is transmitted from separation roller 3 via rotation shaft 21, planetary gear support sections 22A, 22B, planetary gears 23A, 23B, and internally-toothed gear 25 thus causing geared section 24 to further rotate in the clockwise direction.

When disc member 14 that is integral with geared section 24 further rotates in the clockwise direction with sliding pin 31 at the innermost part of groove 43B as shown in FIG. 9, lever member 15 rotates in association with the rotation of disc member 14 as shown in FIG. 12A. Accordingly, even when the length in the direction of transfer of manuscript 55 is greater than 356 mm, separation roller 3 rotates following the rotation of lever member 15. Disc member 14 also rotates without disturbing the rotation of separation roller 3. Consequently, even a long manuscript can be transferred.

Meanwhile, in this exemplary embodiment, each triplet of grooves 41A, 41B, 41C, grooves 43A, 43B, 43C, and grooves 44A, 44B, 44C is disposed at even intervals in a manner symmetric with respect to the center of disc member 14. The number of sets of grooves is not limited to three. Engagement grooves, slide grooves for peripheral speed difference, and slide grooves for manuscript interval may be disposed in pairs, in quadruplets or in larger combinations.

Figure 13:
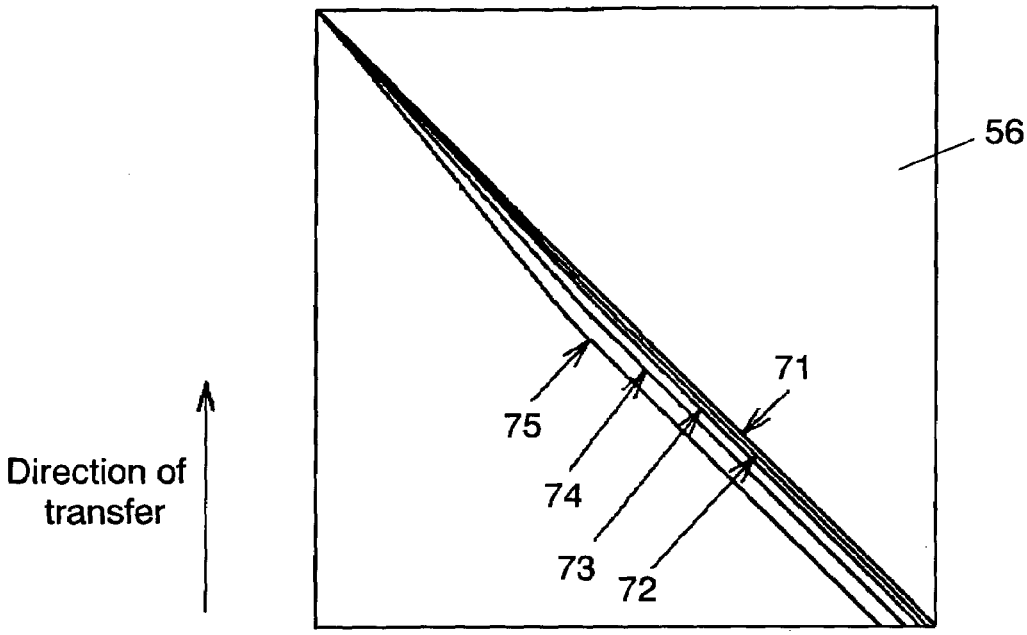
FIG. 13 is an illustration of a part of a printed paper when a slanting line is printed on a printing paper by changing the peripheral speed difference between the separation roller and the transfer roller to various values in the discrete paper feeder of FIG. 1.
Figure 14:
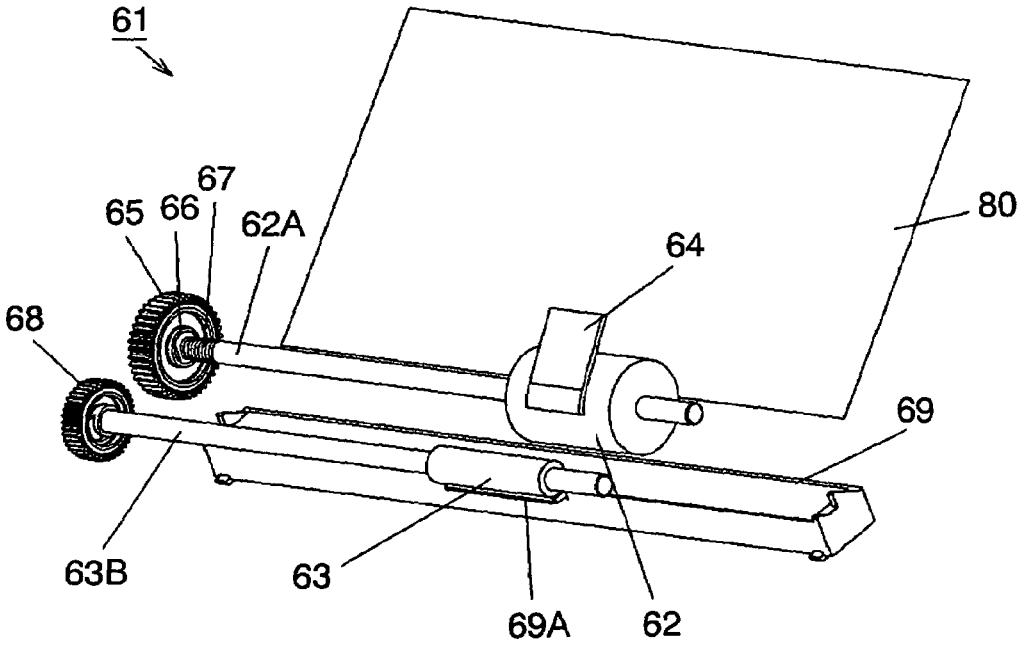
FIG. 14 PRIOR ART
FIG. 14 is a schematic perspective view of an essential part of an example of a conventional discrete paper feeder.

Next, a description will be given of the peripheral speed difference of separation roller 3 and transfer roller 4. FIG. 13 is an illustration of a part of recording paper 56 when slanting lines 71 to 75 are printed on recording paper 56 as fed from loading section 2A while changing the peripheral speed difference of separation roller 3 and transfer roller 4.

As shown in FIG. 13, when the peripheral speed difference of separation roller 3 and transfer roller 4 is 5%, slanting line 73 is obtained, in which scarcely any distortion of the line is observed, compared with slanting line 72 with peripheral speed difference of 2.5% and slanting line 71 with peripheral speed difference of 0%. Slanting line 74 and slanting line 75 are for the cases of peripheral speed differences of 10% and 18%, respectively.

On the other hand, when the peripheral speed difference is 1% or lower, the peripheral speed difference of separation roller 3 and transfer roller 4 becomes negligible and separation roller 3 does not undergo extra rotation corresponding to the peripheral speed difference in the step of "(3) Reading a manuscript" as described earlier. Especially in the case where the minimum length of manuscript that is readable is fixed, there is a risk that slide pin 31 cannot move from groove 41B of disc member 14 to the side of outer groove 43B before the rear end of a manuscript leaves separation roller 3. For this reason, it is preferable that the peripheral speed difference between separation roller 3 and transfer roller 4 be set in the range 1% to 5%, more preferably, in the range 2.5% to 3.5%.

Discrete paper feeder 1 of this exemplary embodiment has reader 5. However, in the case recording paper is to be fed rather than a manuscript as in a printer, reader 5 is not necessary.

As described above, the discrete paper feeder of the present invention shortens the distance in the direction of transfer of paper by disposing a reader between a separation roller and a transfer roller. This enables reduction in size and manufacturing cost. Also, by making peripheral speed difference between the separation roller and the transfer roller small, distortion and elongation of a recorded image of a manuscript can be prevented. Furthermore, even when the peripheral speed difference is made small, it is possible to put a predetermined interval between two or more pages of a manuscript that are transferred in sequence. That is, when a manuscript page leaves the separation roller, rotation of the separation roller stops and the rotation of a sun gear is transmitted to an internally-toothed gear by the rotation of planetary gears. This causes a disc member to rotate. The separation roller remains at a standstill until the disc member starts to rotate and comes in contact with a slide pin provided on a lever member. As a result, the next manuscript page is not fed thus resulting in an increase in the interval of manuscript pages to be fed in sequence. Even when the peripheral speed difference between the separation roller and the transfer roller is made small, it is possible to put a predetermined interval between two or more pages of a manuscript that are transferred in sequence. Also, rotation of the drive motor can always be in one direction thus not requiring reversion.

Also, a pressing member is slidably disposed on the side of the disc member within a rotation stopping member of the lever member. Furthermore, a resilient member is disposed in the rotation stopping section so that the pressing member is pressed to the periphery of the disc member by the resilient member. With this configuration, the lever member is constantly urged toward the radially outer side of the disc member thus enabling free setting of the engaging position of the lever member.

Also, when transferring a manuscript that is longer than normal manuscripts, a slide pin moves to the innermost part of a slide groove for peripheral speed difference. Furthermore, as a geared section and the disc member rotate in the clockwise direction, the lever member rotates clockwise apart from an engagement member. Consequently, even for a manuscript with a length greater than normal, the separation roller rotates following the manuscript. The disc member also rotates without disturbing the rotation of the separation roller. As a result, even a long manuscript can be transferred.

Also, by disposing two or more of each of the engagement groove, slide groove for peripheral speed difference and slide groove for manuscript interval, the lengths of the slide groove for peripheral speed difference and slide groove for manuscript interval of this discrete paper feeder can be set as appropriate thus providing an adequate manuscript interval.

What is claim is:

1. A discrete paper feeder comprising:

a separation roller for separating a single sheet of paper from a plurality of paper sheets;

a transfer roller arranged so as to be downstream of said separation roller in a direction of transfer of said sheet of paper and driven to rotate with a predetermined peripheral speed difference with respect to said separation roller;

a sun gear;

a ring-shaped geared section provided coaxially with said sun gear and having an internally-toothed gear on an inner periphery;

a planetary gear support section provided at an end portion of a rotation shaft of said separation roller;

a planetary gear supported on said planetary gear support section and engaging said sun gear and said internally-toothed gear;

a disc member having a first side secured to said ring-shaped geared section and a second side, opposite said first side, having at least one groove formed therein;

a lever member provided on said second side of said disc member in a manner slidable in a radial direction of said disc member; and a slide pin projecting from said lever member and slidable along said at least one groove of said disc member upon rotation of said disc member.

2. The discrete paper feeder of claim 1, further comprising a reader for reading contents of said sheet of paper and provided between said separation roller and said transfer roller.

3. The discrete paper feeder of claim 1, wherein said disc member includes an engagement section at an end of said at least one groove to engage said slide pin.

4. The discrete paper feeder of claim 1 further comprising a rotation stopping section for regulating rotation of said lever member in a predetermined direction.

5. The discrete paper feeder of claim 4, further comprising:

a pressing member pressed to a periphery of said disc member; and a resilient member, having a first end supported by said pressing member and a second end supported by said rotation stopping section, for pressing said pressing member to an outer edge of said disc member to thereby urge said lever member outwardly of said disc member.

6. The discrete paper feeder of claim 1, wherein said at least one groove of said disc member includes:

an engagement groove having an engagement section for engaging said slide pin;

a slide groove for peripheral speed difference disposed in series with said engagement groove along a periphery of said disc member; and a slide groove for manuscript interval disposed in series with said slide groove for peripheral speed difference and disposed in a manner extending from said slide groove for peripheral speed difference to the periphery of said disc member.

7. The discrete paper feeder of claim 1, wherein said at least one groove of said disc member includes a plurality of engagement grooves having engagement sections, respectively, for engaging said slide pin; a plurality of slide grooves for peripheral speed difference disposed in series with said engagement grooves, respectively, along a periphery of said disc member; and a plurality of slide grooves for manuscript interval disposed in series with said slide grooves for peripheral speed difference, respectively, and disposed in a manner extending from said slide grooves for peripheral speed difference, respectively, to the periphery of said disc member; wherein said slide grooves for peripheral speed difference, and said slide grooves for manuscript interval are disposed respectively at even angular intervals about a center of said disc member; and wherein each of said slide grooves for manuscript interval extends toward the periphery of said disc member and connects to each of neighboring ones of said engagement grooves.

8. The discrete paper feeder of claim 6, wherein a plurality of said engagement sections are disposed on said disc member in a manner symmetric with respect to a center of rotation of said disc member.

9. The discrete paper feeder of claim 1, further comprising a drive motor for rotating said sun gear.

10. The discrete paper feeder of claim 1, further comprising a paper loading section for feeding said paper sheets to said separation roller.

11. A discrete paper feeder comprising:

a separation roller for separating a single sheet of paper from a plurality of paper sheets;

a transfer roller arranged so as to be downstream of said separation roller in a direction of transfer of said sheet of paper and driven to rotate with a predetermined peripheral speed difference with respect to said separation roller;

a sun gear;

a ring-shaped geared section provided coaxially with said sun gear and having an internally-toothed gear on an inner periphery;

a planetary gear support section provided at an end portion of a rotation shaft of said separation roller;

a planetary gear supported on said planetary gear support section and engaging said sun gear and said internally-toothed gear;

a disc member having a first side secured to said ring-shaped geared section and a second side, opposite said first side, having a groove formed therein;

a lever member provided on said second side of said disc member in a manner slidable in a radial direction of said disc member; and a slide pin projecting from said lever member and slidable along said groove of said disc member upon rotation of said disc member; wherein, when said sheet of paper is bitten by both said separation roller and said transfer roller, said disc member rotates by the peripheral speed difference between said separation roller and said transfer roller, and the peripheral speed difference between said separation roller and said transfer roller is absorbed by moving of said slide pin in said groove, and, when said sheet of paper leaves said separation roller, said disc member undergoes reverse rotation while said slide pin moves in a reverse direction in said groove thus interrupting transmission of driving force from said sun gear to said separation roller until said slide pin engages.

12. The discrete paper feeder of claim 11, wherein said disc member includes an engagement section at an end of said groove to engage said slide pin.

13. The discrete paper feeder of claim 11, further comprising a rotation stopping section for regulating rotation of said lever member in a predetermined direction; wherein, when said sheet of paper is bitten by said separation roller only, the driving force from said sun gear is transmitted to said separation roller via said planetary gear support section by stopping the rotation of said ring-shaped geared section with said rotation stopping section and said lever member having said slide pin.

14. The discrete paper feeder of claim 13, further comprising:

a pressing member to be pressed to a periphery of said disc member; and a resilient member, having a first end supported by said pressing member and a second end supported by said rotation stopping section, for pressing said pressing member to an outer edge of said disc member to thereby urge said lever member outwardly of said disc member.

15. A discrete paper feeder comprising a separation roller for separating a single sheet of paper from a plurality of paper sheets, a transfer roller arranged so as to be downstream of said separation roller in a direction of transfer of said sheet of paper and driven to rotate faster than said separation roller by a predetermined peripheral speed difference with respect to said separation roller, and a driving force control section for transmitting driving force to said separation roller, wherein said driving force control section includes:

a sun gear;

a ring-shaped geared section provided coaxially with said sun gear and having an internally-toothed gear on an inner periphery;

a planetary gear support section provided at an end portion of a rotation shaft of said separation roller;

a planetary gear supported on said planetary gear support section and engaging said sun gear and said internally-toothed gear;

a disc member having a first side secured to said ring-shaped geared section and a second side, opposite said first side, having a groove formed therein;

a lever member provided on the second side of said disc member in a manner slidable in a radial direction of said disc member; and a slide pin projecting from said lever member and slidable along said groove of said disc member upon rotation of said disc member;

wherein said driving force control section interrupts transmission of driving force to said separation roller for a predetermined period when said slide pin slides in said groove after said sheet of paper leaves said separation roller.

16. The discrete paper feeder of claim 15, wherein said driving force control section further includes a rotation stopping section for regulating rotation of said lever member in a predetermined direction.

* * * * *